US010729613B2

(12) United States Patent
Copetti

(10) Patent No.: US 10,729,613 B2
(45) Date of Patent: Aug. 4, 2020

(54) BED BASE AND BED PROVIDED WITH SAID BED BASE, WHEREIN THE BED BASE IS PROVIDED WITH MASSAGING MEANS

(71) Applicant: Valter Copetti, Gemona del Friuli (IT)

(72) Inventor: Valter Copetti, Gemona del Friuli (IT)

( * ) Notice: Subject to any disclaimer, the term of this patent is extended or adjusted under 35 U.S.C. 154(b) by 512 days.

(21) Appl. No.: 15/520,203

(22) PCT Filed: Oct. 23, 2015

(86) PCT No.: PCT/EP2015/002111
§ 371 (c)(1),
(2) Date: Apr. 19, 2017

(87) PCT Pub. No.: WO2016/062408
PCT Pub. Date: Apr. 28, 2016

(65) Prior Publication Data

US 2017/0312155 A1 Nov. 2, 2017

(30) Foreign Application Priority Data

Oct. 23, 2014 (IT) ..... U2014A0167

(51) Int. Cl.
*A61G 7/057* (2006.01)
*A47C 20/04* (2006.01)
(Continued)

(52) U.S. Cl.
CPC ..... *A61H 23/02* (2013.01); *A47C 20/041* (2013.01); *A47C 20/08* (2013.01); *A61H 7/001* (2013.01);
(Continued)

(58) Field of Classification Search
CPC ..... A61G 7/015; A61G 7/002; A61G 7/018; A61G 7/0573; A61G 7/057; A61H 2201/0142; A61H 2201/0146; A61H 2201/0138; A61H 2023/0272; A61H 1/00; A61H 1/006; A61H 1/02; A61H 1/008; A61H 1/005; A61H 1/001; A61H 1/003; A47C 21/00; A47C 21/006; A47C 21/06; A47C 21/02; A47C 21/002; A47C 21/024;
(Continued)

(56) References Cited

U.S. PATENT DOCUMENTS 2,790,440 A * 4/1957 Adair Robin, Jr. .. A61G 7/0573 601/92
3,644,946 A * 2/1972 Swatt ..... A47C 20/041 5/616
(Continued)

OTHER PUBLICATIONS

Amazon.com, 24V 500W Electric Motor, https://www.amazon.conn/Universal-Parts-500W-Electric-Motor/dp/B00J4ZBD2G (Nov. 17, 2010) (Year: 2010).*

*Primary Examiner* — Samchuan C Yao
*Assistant Examiner* — Vincent D Hoang
(74) *Attorney, Agent, or Firm* — Egbert, McDaniel & Swartz, PLLC

(57) ABSTRACT

Bed base and bed provided with the bed base, wherein the bed base is provided with massaging apparatuses having slats which are placed one after the other and which define a support plane for a mattress, wherein the massaging apparatuses include a first drive which activates a first series of slats for a massaging action and a second drive which activates a second series of slats for a massaging action.

19 Claims, 11 Drawing Sheets

(51) Int. Cl.

| | |
|---|---|
| ***A61H 23/02*** | (2006.01) |
| ***A47C 20/08*** | (2006.01) |
| ***A61H 7/00*** | (2006.01) |
| ***A47C 21/00*** | (2006.01) |
| ***A47C 19/02*** | (2006.01) |
| *A47C 20/00* | (2006.01) |
| *A47C 20/06* | (2006.01) |
| *A47C 20/02* | (2006.01) |
| *A47C 23/06* | (2006.01) |

(52) U.S. Cl.
CPC ..... *A47C 20/00* (2013.01); *A47C 20/02* (2013.01); *A47C 20/06* (2013.01); *A47C 21/006* (2013.01); *A47C 23/06* (2013.01); *A61G 7/057* (2013.01); *A61G 7/0573* (2013.01); *A61H 2201/0107* (2013.01); *A61H 2201/0142* (2013.01); *A61H 2201/1215* (2013.01); *A61H 2201/149* (2013.01); *A61H 2201/1418* (2013.01); *A61H 2201/1654* (2013.01); *A61H 2201/5035* (2013.01); *A61H 2201/5097* (2013.01)

(58) Field of Classification Search
CPC ..... A47C 19/025; A47C 31/02; A47C 20/00; A47C 20/06; A47C 20/02; A47C 23/06
USPC ..... 5/402, 407, 409; 601/98
See application file for complete search history.

(56) References Cited

U.S. PATENT DOCUMENTS

| | | | | | |
|---|---|---|---|---|---|
| 3,656,190 | A * | 4/1972 | Regan | A47C 23/00 | 5/613 |
| 4,999,861 | A * | 3/1991 | Huang | A47C 21/006 | 5/600 |
| 5,626,555 | A * | 5/1997 | Di Blasi | A47C 21/006 | 601/98 |
| 5,862,550 | A * | 1/1999 | Cosani | A61G 7/0573 | 5/612 |
| 6,432,072 | B1 * | 8/2002 | Harris | A61H 23/0254 | 601/101 |
| 6,799,342 | B1 * | 10/2004 | Jarmon | A61G 7/0573 | 5/191 |

* cited by examiner

BED BASE AND BED PROVIDED WITH SAID BED BASE, WHEREIN THE BED BASE IS PROVIDED WITH MASSAGING MEANS

TECHNICAL FIELD

The present invention relates to a bed base for an anti-decubitus bed according to the characteristics of the pre-characterizing part of claim 1.

The present invention also relates to an anti-decubitus bed.

PRIOR ART

In the field of treatment of bedridden patients the use of beds with anti-decubitus systems is known. Because of the reduction of the blood circulation due to the prolonged mechanical compression of some zones of the patient's body near the support surface on the bed, some problems of necrosis, lacerations and ulcers known as "bedsores" may arise.

Many prior art solutions provide pneumatic mattresses, which cause a movement of the patient on the bed by means of successive phases of inflation and deflation of different portions of the mattress.

Patent Application DE 19632611 describes a bed provided with pistons, which are lifted and are lowered to modify the distribution of pressure in the bed.

Furthermore, beds are known in which some portions of the bed can be lifted with respect to a central portion of the bed, for example the portion on which the patient's chest rests or the portion on which the patient's legs rest which can be lifted with respect to the portion on which the patient's buttocks rest.

Italian patent FE1988A009003 describes a bed for long-term patients, which comprises soft modules which exert a diversified pressure along the longitudinal development of the bed. The bed is provided with portions, which can be lifted in correspondence of the zone of the chest and in correspondence of the zone of the legs. The modules are moved vertically by means of a cam system, which is moved by means of a shaft which rotates on its axis. The rotary shaft develops over the entire length of the bed and is provided with intermediate articulations shaped as a universal joint which allow for the rotation of the shaft also in the conditions in which the bed is placed according to different configurations of the liftable portions. The rotation of the shaft is controlled by means of a rotary actuator connected to the shaft by means of pulleys.

Problems of the Prior Art

Many prior art solutions are intended for use in the case in which the problem of bedsores has already arisen and are unsuitable for effectively preventing their formation.

For example the solutions which provide the use of pneumatic mattresses only cannot ensure an effective detachment of the patient from the bed in the contact zones but are generally limited to creating pressure changes in some zones.

Furthermore, the resort to solutions which use only mattresses provided with selectively or consecutively inflatable zones can also imply the occurrence of further problems due to the movement of the support surface of the patient or of the sheets with the consequent occurrence of phenomena of friction between the sheets and the patient's body which in their turn can cause injuries or cause pains in the zones already affected by bedsores.

Aim of the Invention

The aim of the present invention is to provide a bed base and an anti-decubitus bed with improved efficiency which allow for an effective action on the user's body also in the configurations in which one or more portions of the support plane of the mattress are partially lifted or bent with respect to a condition in which the support plane of the mattress is horizontal.

A further aim of the present invention is to provide a bed base and an anti-decubitus bed which allow to prevent the occurrence of bedsores.

Concept of the Invention

The aim is achieved by the characteristics of the main claim. The sub-claims represent advantageous solutions.

Advantageous Effects of the Invention

The solution according to the present invention, by the considerable creative contribution the effect of which constitutes an immediate and important technical progress, presents various advantages.

The bed base and the anti-decubitus bed made according to the present invention allow to lift and lower portions of the support plane of the mattress so that the user can position himself/herself according to different positions, for example with the chest more or less inclined with respect to the pelvis, with the legs lifted, etc. At the same time the bed base and the anti-decubitus bed made according to the present invention allow to perform an effective massaging action on the user's body also in the configurations in which one or more portions of the support plane of the mattress are partially lifted or bent with respect to a condition in which the support plane of the mattress is horizontal.

Advantageously, the resort to the bed base and to the anti-decubitus bed made according to the present invention allow to obtain a continuous movement of the user preventing the occurrence of bedsores and is not limited to be used in the case in which the bedsores are already present.

DESCRIPTION OF THE DRAWINGS

In the following a solution is described with reference to the enclosed drawings, which are to be considered as a non-exhaustive example of the present invention in which.

DESCRIPTION OF THE INVENTION

Figure 1:
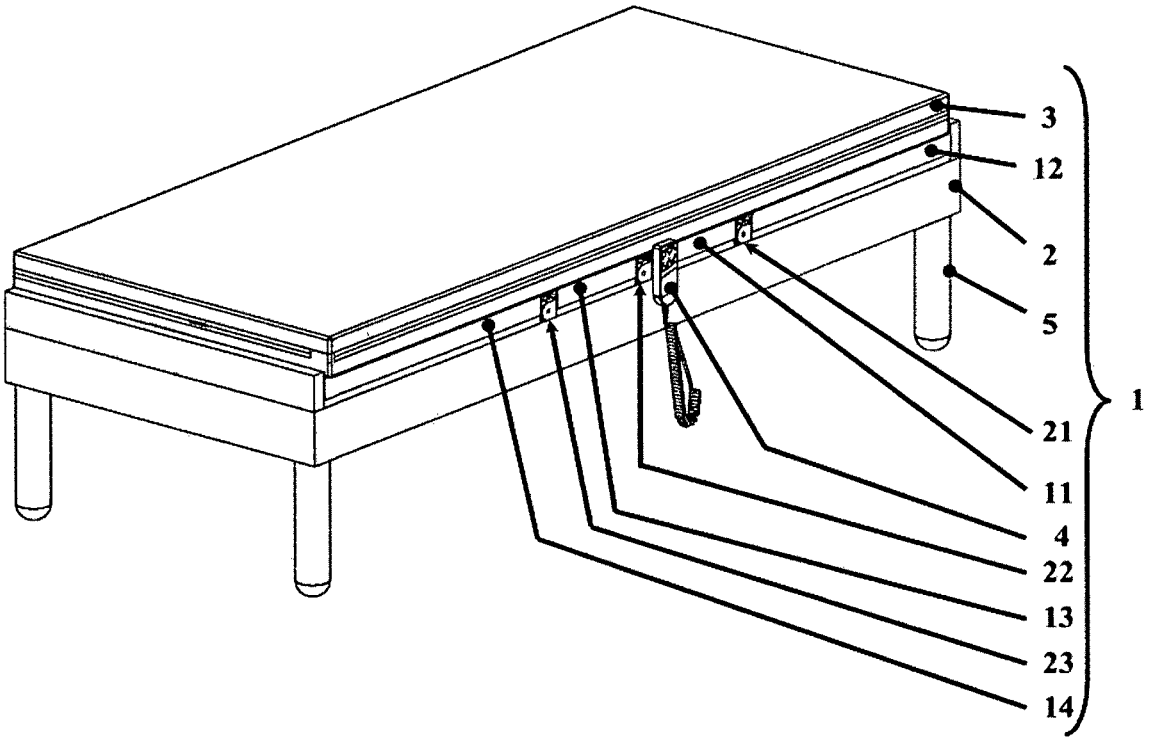
FIG. 1 shows a perspective view of the bed made in accordance with the present invention.
Figure 2:
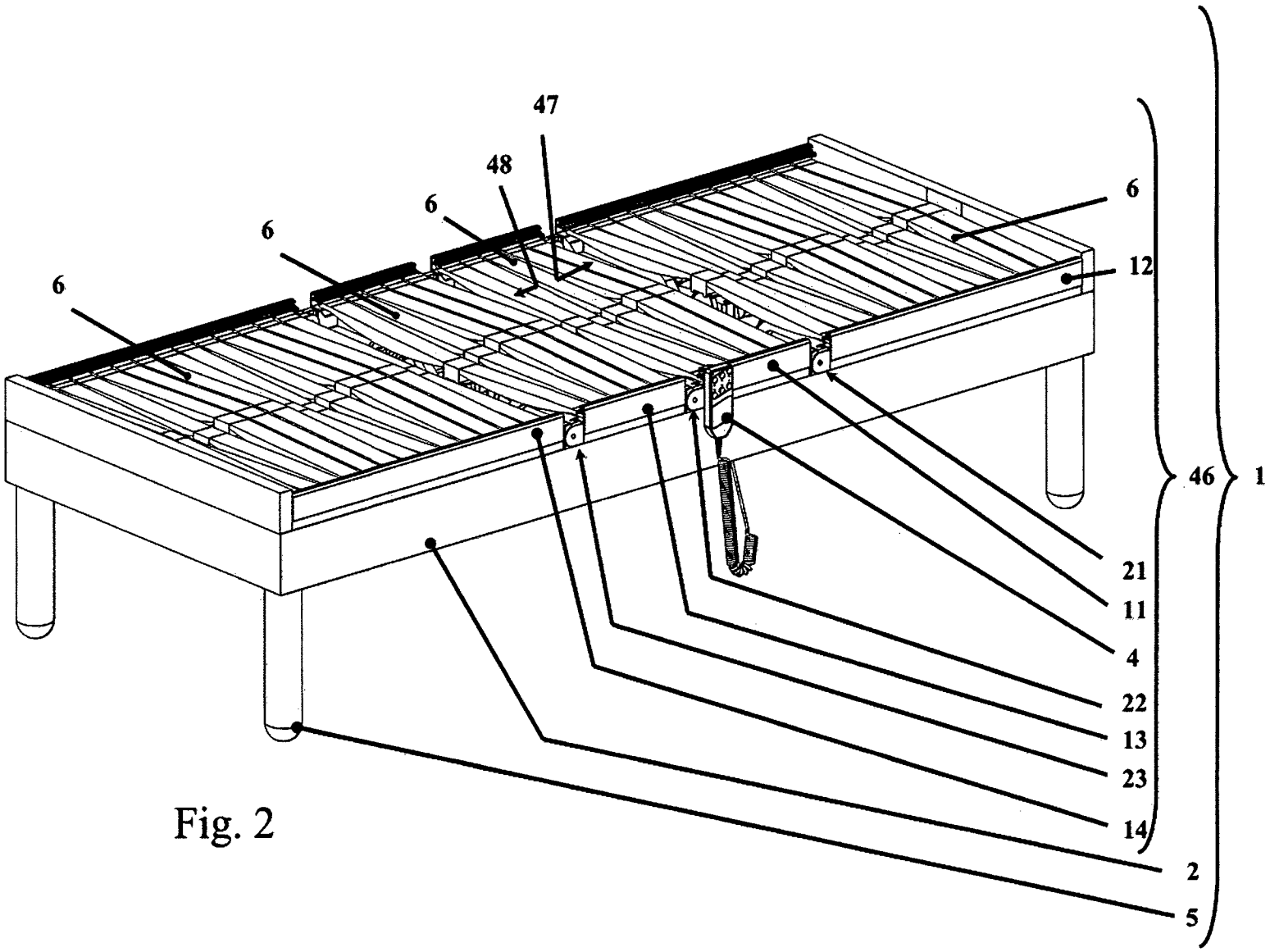
FIG. 2 shows a perspective view of the bed of FIG. 1 in which the mattress has been removed and in which the bed base according to the invention can be seen.
Figure 3:
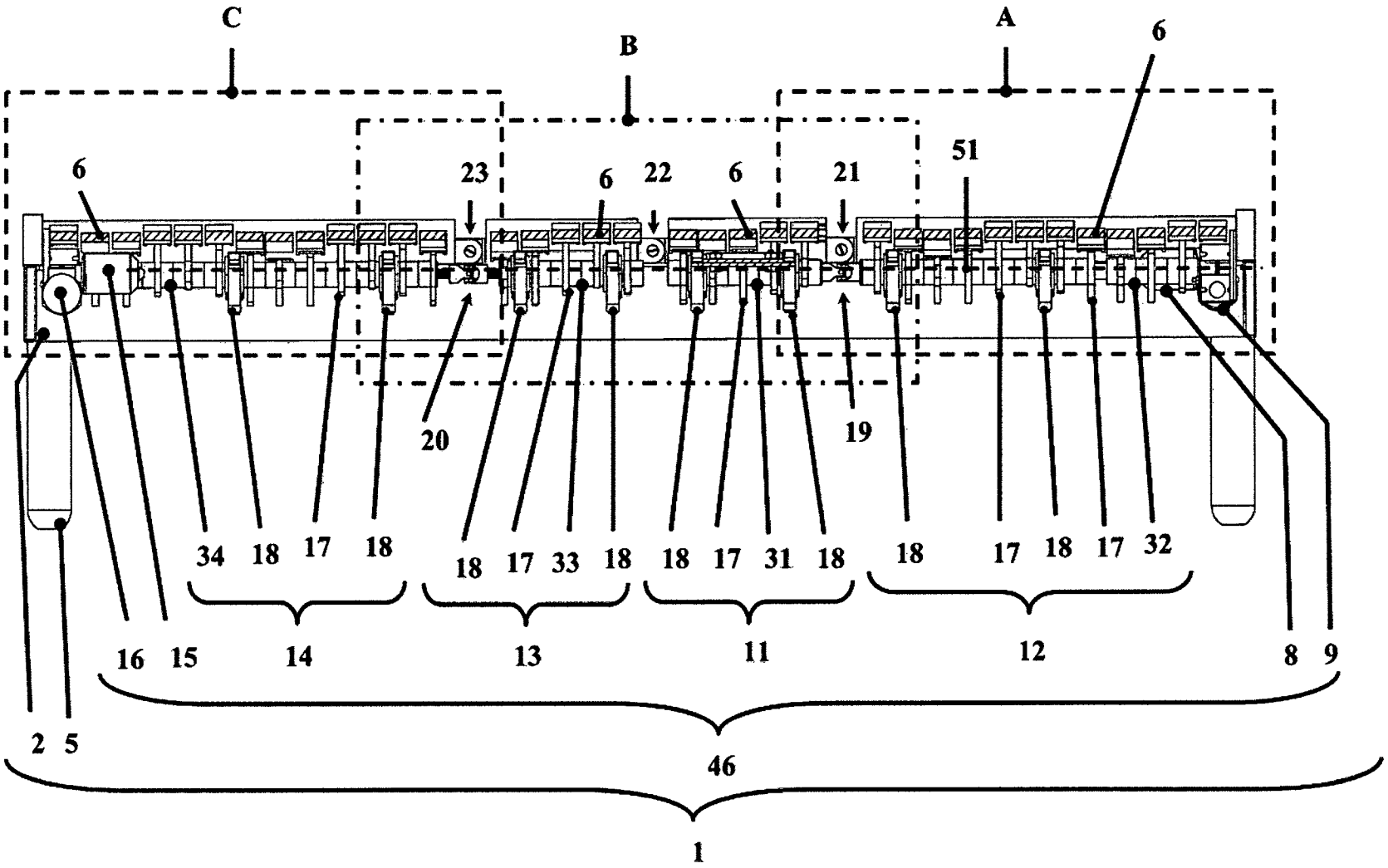
FIG. 3 shows a sectional side view of the bed of FIG. 2 in which the bed base according to the invention can be seen.
Figure 4:
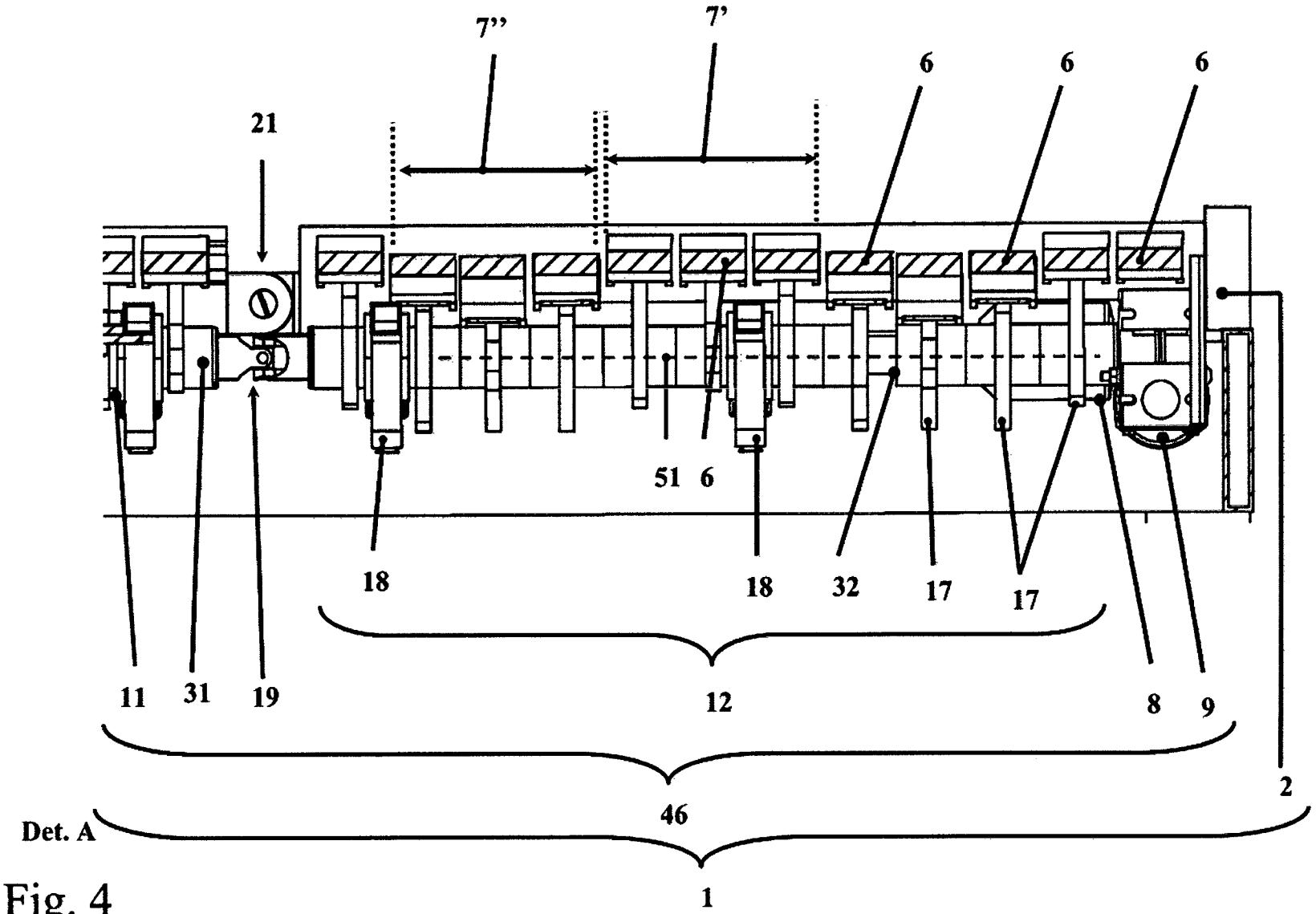
FIG. 4 shows a side view of the detail indicated with "A" in FIG. 3.
Figure 5:
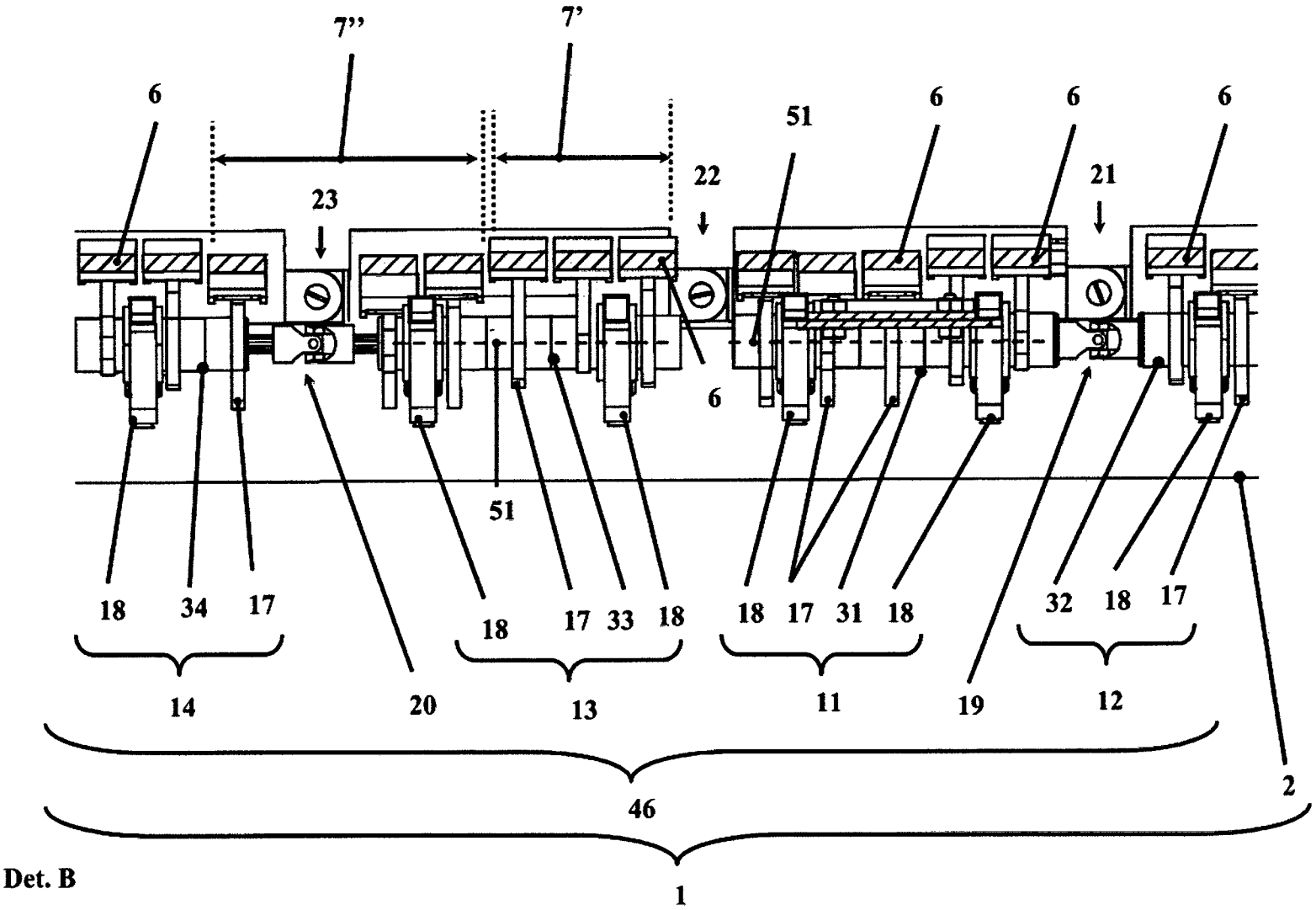
FIG. 5 shows a side view of the detail indicated with "B" in FIG. 3.
Figure 6:
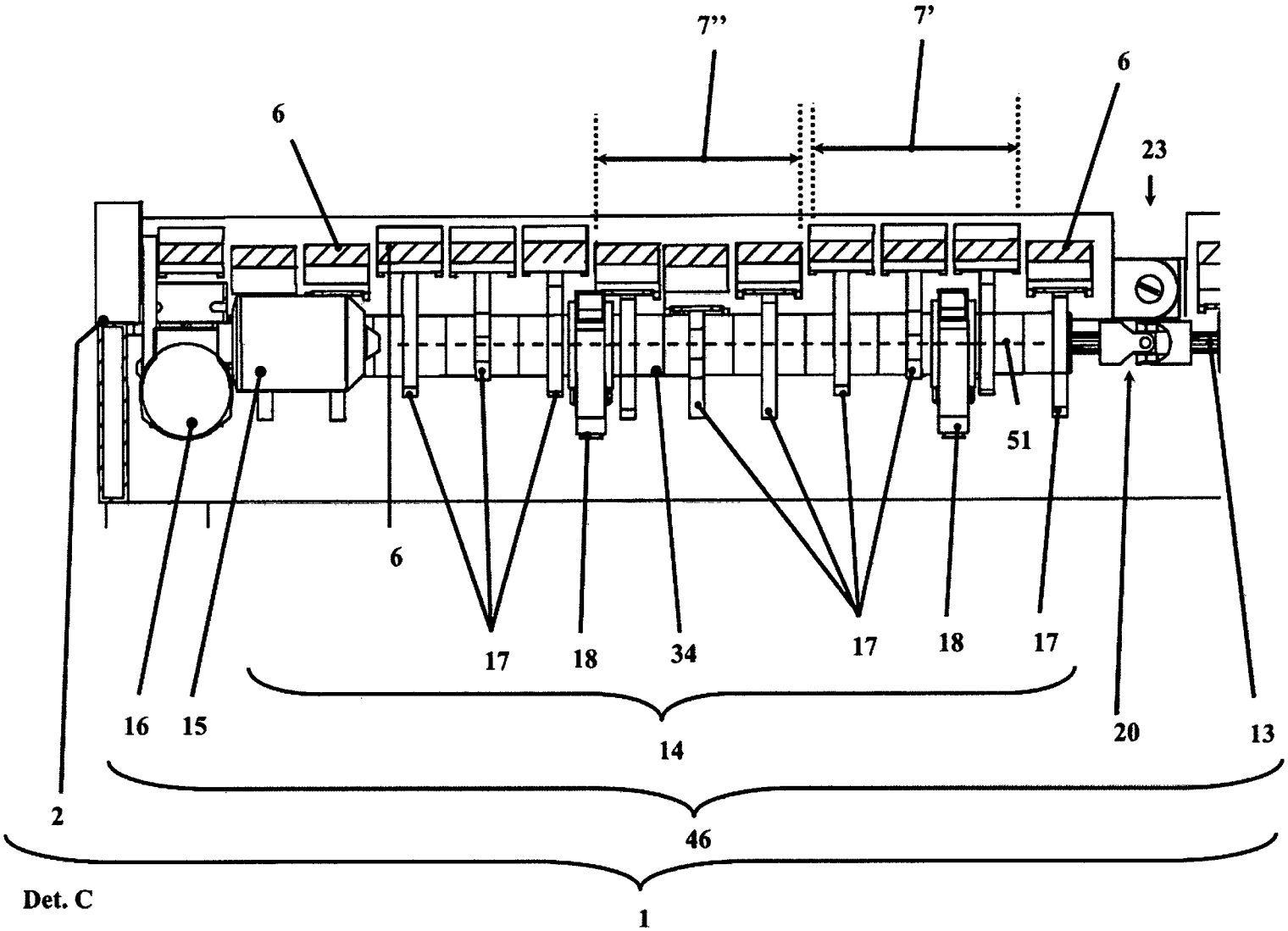
FIG. 6 shows a side view of the detail indicated with "C" in FIG. 3.
Figure 7:
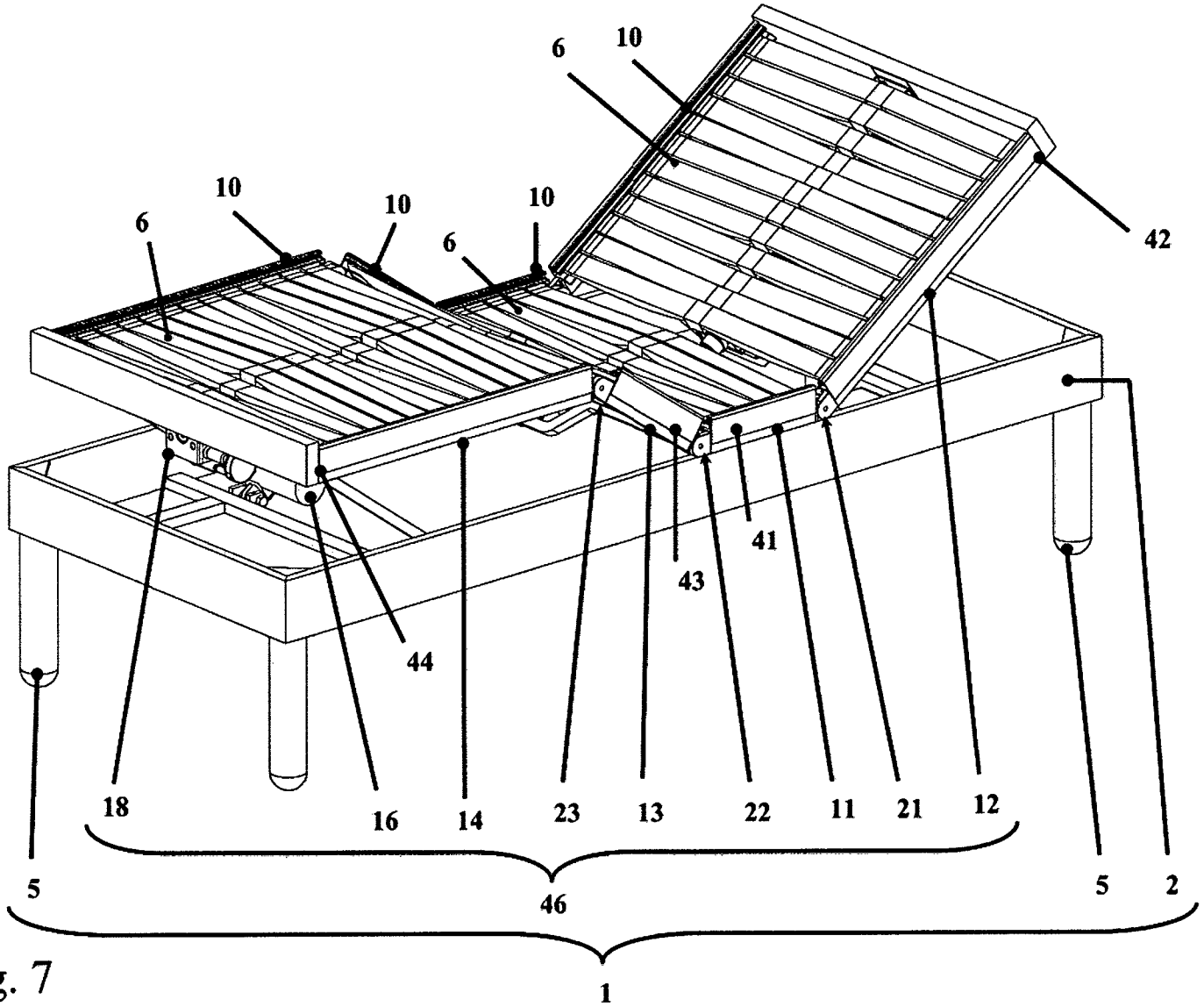
FIG. 7 shows a view of the bed of FIG. 2 in one of the possible modes of use of the bed and bed base according to the invention.
Figure 8:
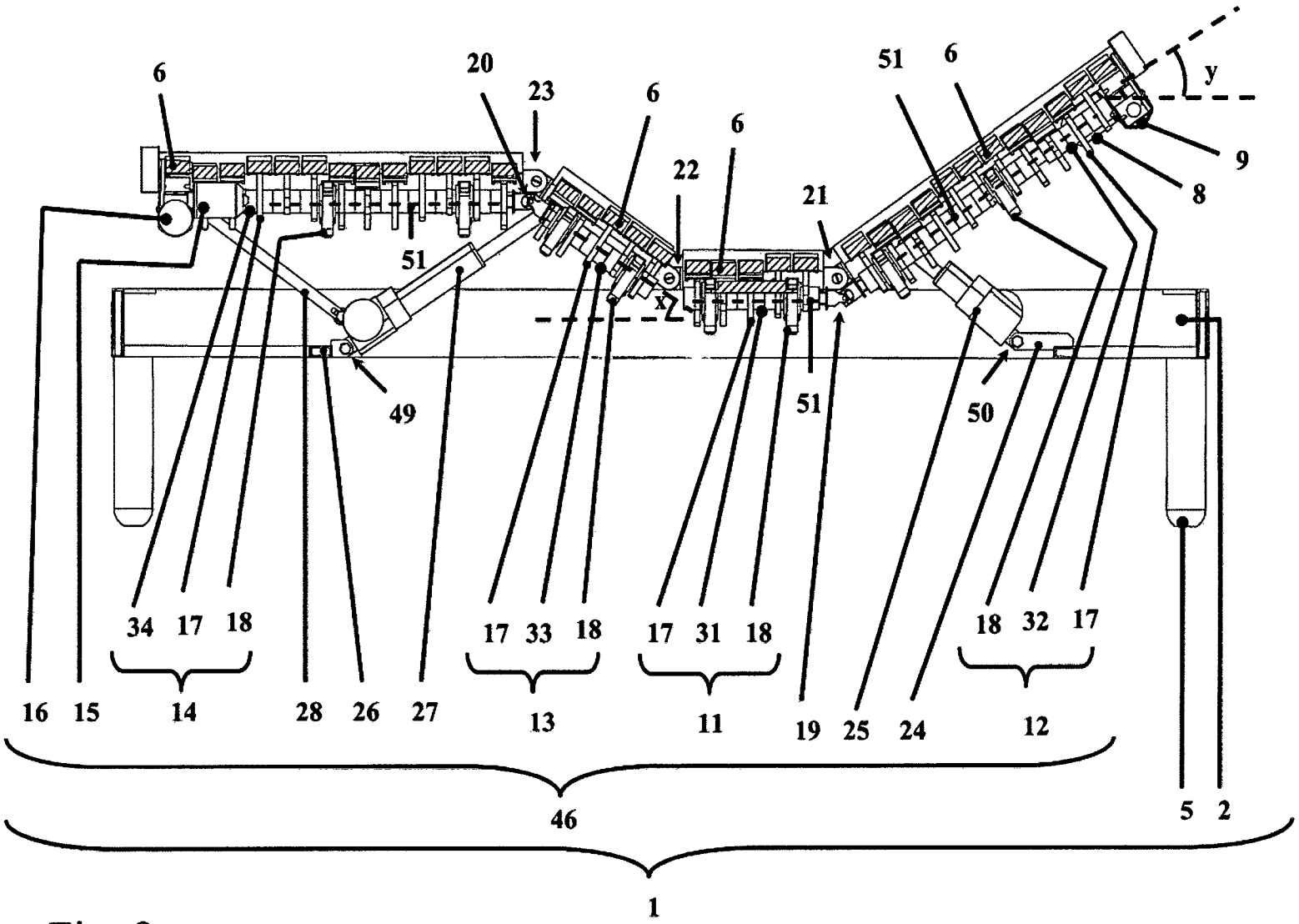
FIG. 8 shows a sectional side view of the bed of FIG. 7.
Figure 9:
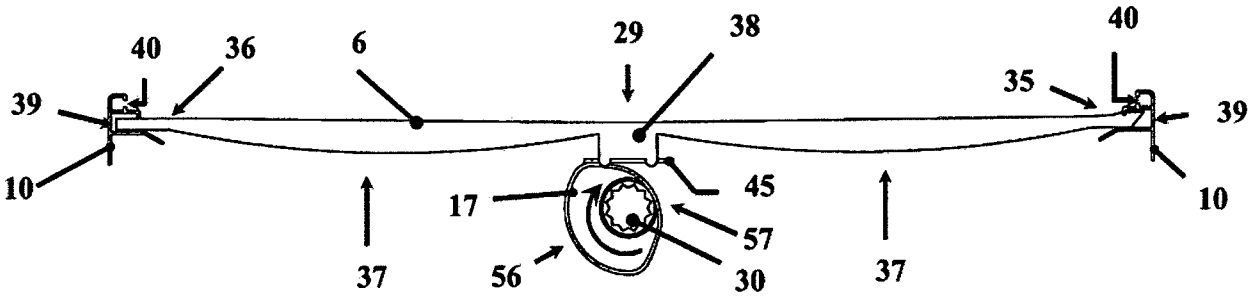
FIG. 9 shows a front view of one of the slats of the bed of FIG. 2 in which one can also see the respective massaging mechanism in a first working condition.
Figure 10:
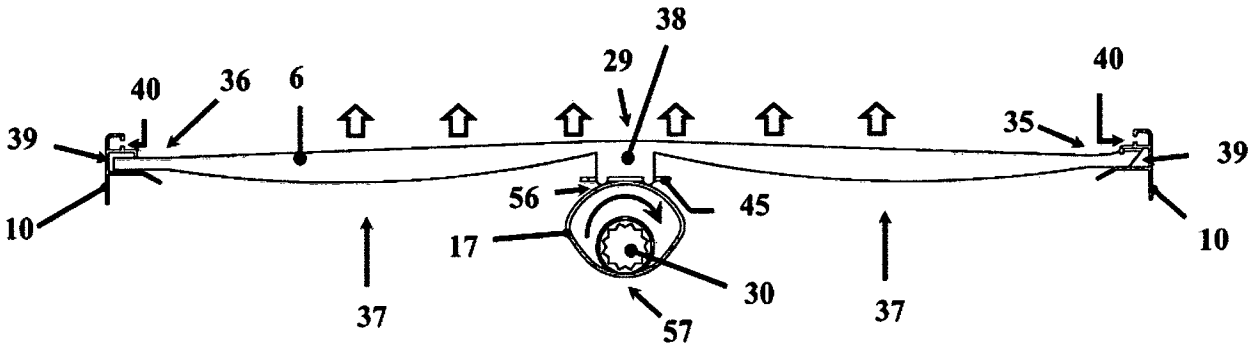
FIG. 10 shows a front view of one of the slats of the bed of FIG. 2 in which one can also see the respective massaging mechanism in a second working condition.
Figure 11:
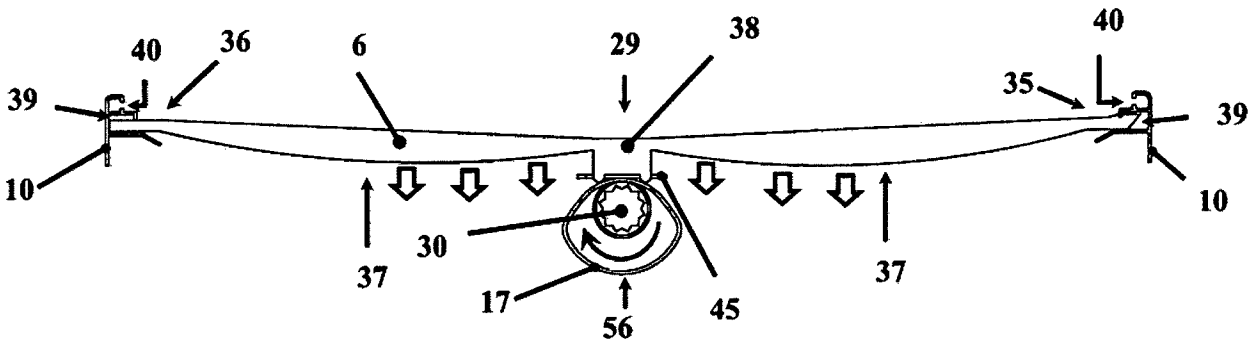
FIG. 11 shows a front view of one of the slats of the bed of FIG. 2 in which one can also see the respective massaging mechanism in a third working condition.
Figure 12:
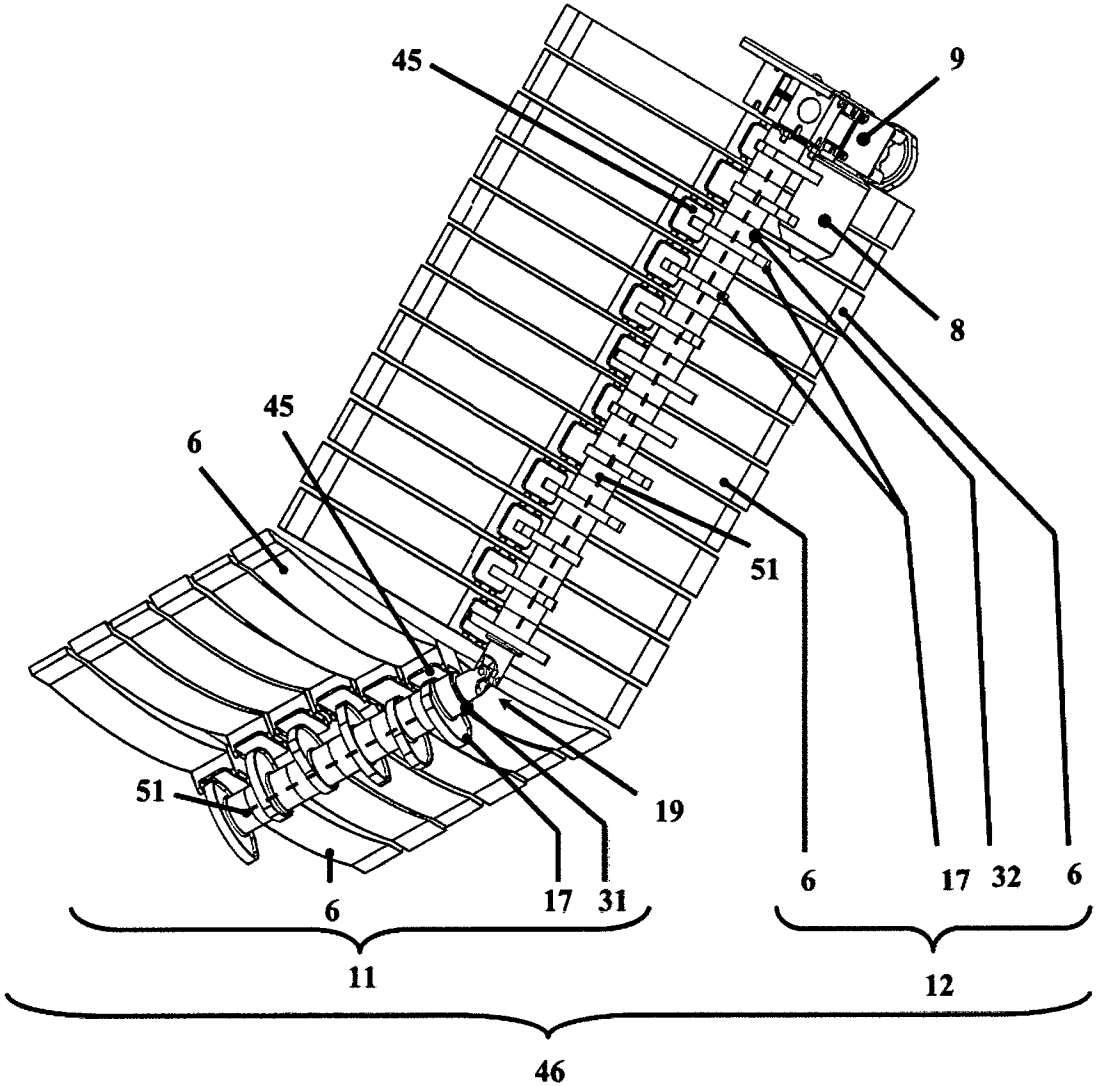
FIG. 12 shows a perspective view from the bottom of the bed base according to the invention.

With reference to the figures (FIG. 1, FIG. 2) the anti-decubitus bed (1) made according to the present invention includes a structure (2) supported by feet (5) of support on the ground. On the structure (2) one applies (FIG. 2, FIG. 3, FIG. 4, FIG. 5, FIG. 6, FIG. 7, FIG. 8, FIG. 9, FIG. 10, FIG. 11, FIG. 12) the bed base (46) made according to the present invention, which in its turn supports (FIG. 1) a mattress (3).

The bed base (46) and, therefore, the bed (1) are subdivided into contiguous portions (11, 12, 13, 14) which can be moved with respect to each other, preferably into a first portion (11), a second portion (12), a third portion (13), a fourth portion (14). In particular the portions (11, 12, 13, 14) can be positioned according to at least two configurations, a first configuration of which is a substantially flat configuration in which the contiguous portions are (FIG. 1, FIG. 2, FIG. 3, FIG. 4, FIG. 5, FIG. 6) aligned with respect to each other and form a substantially flat surface arranged on a horizontal plane, and a second configuration of which is a configuration (FIG. 7, FIG. 8, FIG. 12) in which at least one of the portions is inclined with respect to the following portion or in which several portions are inclined with respect to the respective adjacent portions. For example the second configuration can be a configuration in which the second portion (12) is inclined with respect to the substantially flat surface formed by the other portions (11, 13, 14) to lift only the chest of the user, who will thus assume a substantially sitting or nearly sitting position. For example the second configuration can be a configuration in which the third portion (13) is inclined with respect to the substantially flat surface formed by the first portion (11) and the fourth portion (14) is lifted in a condition of parallelism with respect to the first portion (11). It will be evident that by the combination of the described movements one can obtain multiple positioning configurations of the portions (11, 12, 13, 14) of the bed base (46) or, correspondingly, of the bed (1).

Preferably the first portion (11) is a fixed portion, meaning that it remains stationary during the movement of the other portions, said first portion (11) being for example provided with fixing means which fix the bed base (46) according to the invention to the structure (2) of the bed (1) to constitute one single and integral assembly. The first portion (11) can be placed in a longitudinal position corresponding to the support zone of the user's buttocks. Preferably the first portion (11) comprises (FIG. 7) a first frame (41), which acts as a fixing element for a series of slats (6).

The second portion (12) can be the portion, which corresponds to the support zone of the user's back and head. The second portion (12) is fixed (FIG. 2) in a movable way on a first side (47) of the first portion (11) by means of first hinges (21) which allow for a rotational movement of the second portion (12) with respect to the first portion (11), for example to allow the user to assume a position in which the buttocks rest on the first portion (11) placed substantially horizontally while the back is kept inclined with respect to the horizontal position by means of the supporting action of the second portion (12) when it assumes a position inclined by a certain angle with respect to the first portion (11). Preferably the second portion (12) comprises (FIG. 7) a second frame (42) which acts as a fixing element for a series of slats (6).

The third portion (13) can be the portion which corresponds to the support zone of the user's thighs. The third portion (13) is fixed (FIG. 2) in a movable way to the first portion (11) on a second side (48) of the first portion (11) which is opposite with respect to the first side (47) of the first portion on which the second portion (12) is fixed. The third portion (13) is fixed in a movable way to the first portion (11) by means of second hinges (22), which allow for a rotational movement of the third portion (13) with respect to the first portion (11), for example to allow the user to assume a position in which the buttocks rest on the first portion (11) placed substantially horizontally while the thighs are kept inclined with respect to the horizontal position by means of the supporting action of the third portion (13) when it assumes a position inclined by a certain angle with respect to the first portion (11). Preferably the third portion (13) comprises (FIG. 7) a third frame (43), which acts as a fixing element for a series of slats (6).

The fourth portion (14) can be the portion, which corresponds to the support zone of the user's legs and feet. The fourth portion (14) is fixed (FIG. 2) in a movable way to the third portion (13) on one side of the third portion (13) which is opposite with respect to the side of the third portion which is fixed to the first portion (11). The fourth portion (14) is fixed in a movable way to the third portion (13) by means of third hinges (23) which allow for a rotational movement of the fourth portion (14) with respect to the third portion (13), for example to allow the user to assume a position in which the thighs rest on the third portion (13) while the legs are kept inclined with respect to the thighs by means of the supporting action of the fourth portion (14) when it assumes a position inclined by a certain angle with respect to the third portion (13). Preferably the fourth portion (14) comprises (FIG. 7) a fourth frame (44) which acts as a fixing element for a series of slats (6).

The bed base (46) and, therefore, the bed (1) are provided with actuators (25, 27) which control the rotational movement of the portions (12, 13, 14) on the respective hinges (21, 22, 23). The bed base (46) and, therefore, the bed (1) are further provided with driving means (8, 15) which act on a group of shafts (30, 31, 32, 33, 34) which are put in rotation on their axis by means of the driving means (8, 15) to perform a massaging action by means of a plurality of massaging means (6, 7, 17, 31, 32, 33, 34, 8, 15).

The bed base (46) and, therefore, the bed (1) are provided (FIG. 1) with control means (4) for controlling the driving means (8, 15) and the massaging means (6, 7, 17, 31, 32, 33, 34, 8, 15). The control means (4) can be made in the form of a remote control provided with a wire which, connects it to the driving means (8, 15) and to the massaging means (6, 7, 17, 31, 32, 33, 34, 8, 15) or to a control unit of the latter. As an alternative, one can also resort to wireless control means (4) which communicate according to a wireless communication mode with the control unit or with a respective pair of control units of which a first control unit which checks the driving means (8, 15) and a second control unit which checks the massaging means (6, 7, 17, 31, 32, 33, 34, 8, 15).

With particular reference to the actuators (25, 27), they preferably consist of a first actuator (27) and of a second actuator (25).

The first actuator (27) exerts its force on the third portion (13), which is the portion which corresponds to the support zone of the user's thighs. Following the force exerted by the first actuator (27) the third portion (13) is pushed or pulled causing a change of inclination of the third portion (13) with respect to the first portion (11), the third portion (13) rotating by means of the second hinges (22) which allow for the rotational movement of the third portion (13) with respect to the first portion (11). Preferably the lifting of the third portion (13) from the position in which the third portion (13) is placed substantially horizontally to the position in which the third portion (13) is placed substantially inclined by a first angle (x) with respect to the horizontal position occurs by means of the first actuator (27) which exerts a pushing action of the third portion (13) with respect to the structure (2). The lowering of the third portion (13) from the position in which the third portion (13) is placed substantially inclined with respect to the horizontal position to the position in which the third portion (13) is placed substantially horizontally occurs by means of the first actuator (27) which exerts a traction action of the third portion (13) with respect to the structure (2). The first actuator (27) can be fixed to the structure (2) for example by means of a first anchoring element (26) for example in the form of a first fixing arm provided (FIG. 8) with a fourth hinge (49) to realize a coupling between the first anchoring element (26) and the first actuator (27) which allows for the rotation of the first actuator (27) with respect to the first anchoring element (26) in such a way as to allow for the change of the inclination of the first actuator (27) during the phases of pushing and traction of the third portion (13).

The fourth portion (14) is rotationally fixed to the third portion (13) by means of the third hinge (23) but the movement of the fourth portion (14) is limited by means of one or more rods (28). The rods (28) on one side are rotationally fixed to the fourth portion (14) and on the opposite side they are rotationally fixed to the structure (2) or to the first actuator (27) according to a configuration due to which, following the pushing action for lifting the third portion (13) exerted by the first actuator (27):

- the third portion (13) is inclined with respect to the first portion (11) rotating on the second hinge (22) with the consequent lifting of the third hinge (23);
- following the lifting of the third hinge (23) the fourth portion (14) is lifted but it is not inclined due to the traction action exerted by the rod (28) on the opposite side of the fourth portion (14) with respect to the side on which there is the third hinge (23), the fourth portion (14) being kept substantially horizontal.

It will be evident that completely similar conditions also occur during the phases of lowering of the third portion (13) obtained by means of the traction exerted by the first actuator (27). In practice the fourth portion (14) is kept substantially horizontal during the operations of inclination of the third portion (13), constituting a substantially horizontal support for the user's legs.

The second actuator (25) exerts its force on the second portion (12), which is the portion which corresponds to the support zone of the user's back and head. Following the force exerted by the second actuator (25) the second portion (12) is pushed or pulled causing a change of inclination of the second portion (12) with respect to the first portion (11), the second portion (12) rotating by means of the first hinges (21) which allow for the rotational movement of the second portion (12) with respect to the first portion (11). Preferably the lifting of the second portion (12) from the position in which the second portion (12) is placed substantially horizontally to the position in which the second portion (12) is placed substantially inclined by a second angle (y) with respect to the horizontal position occurs by means of the second actuator (25) which exerts a pushing action of the second portion (12) with respect to the structure (2). The lowering of the second portion (12) from the position in which the second portion (12) is placed substantially inclined with respect to the horizontal position to the position in which the second portion (12) is placed substantially horizontally occurs by means of the second actuator (25) which exerts a traction action of the second portion (12) with respect to the structure (2). The second actuator (25) can be fixed to the structure (2) for example by means of a second anchoring element (24) for example in the form of a second fixing arm provided (FIG. 8) with a fifth hinge (50) to realize a coupling between the second anchoring element (24) and the second actuator (25) which allows for the rotation of the second actuator (25) with respect to the second anchoring element (24) in such a way as to allow for the change of the inclination of the second actuator (25) during the phases of pushing and traction of the second portion (12).

The first actuator (27) and the second actuator (25) are preferably made in the form of electrically controllable pistons which act in pushing and in traction as previously described. Furthermore, the bed base (46) and, therefore, the bed (1) are provided with massaging means (6, 7, 17, 31, 32, 33, 34, 8, 15) which cause on the mattress (3) a localised lifting and lowering action in several points arranged over the entire longitudinal development of the bed base (46) or of the bed (1). It will be evident that in different embodiments it can be provided that only some portions of the bed base (46) or of the bed (1) are affected by the massaging means (6, 7, 17, 31, 32, 33, 34, 8, 15). The massaging means are provided with a shaft (30) which transmits a rotational motion by means of drives (8, 15) to a series of cams (17) which in their turn create an oscillatory movement in the vertical direction which in its turn is transmitted to the slats (6) of the bed base (46).

In particular the massaging means (6, 7, 17, 31, 32, 33, 34, 8, 15) comprise a first drive (8) preferably in the form of a first electric motor which is placed (FIG. 3, FIG. 4, FIG. 8, FIG. 12) at the end of the second portion (12). The first electric motor can be a 24 Volt motor. The first drive (8) puts in rotation, if necessary with the interposition of a first reducer (9) a first articulated shaft (31, 32, 19) consisting of a first shaft (31) and a second shaft (32) which are connected to each other by means of a first joint (19), preferably in the form of a first universal joint. The first drive (8) puts in rotation the second shaft (32) which is placed below the second portion (12). The second shaft (32) develops in length according to a respective longitudinal direction (51) along the length of the second portion (12). The second shaft (32) is connected to the first shaft (31) by means of the first joint (19) which allows the second shaft (32) to transmit the rotational motion to the first shaft (31) and at the same time allows to transmit the rotational motion also in the conditions in which the second portion (12) is inclined with respect to the first portion (11). The first shaft (31) develops in length according to a respective longitudinal direction (51) along the length of the first portion (11).

Furthermore, the massaging means (6, 7, 17, 31, 32, 33, 34, 8, 15) comprise a second drive (15) preferably in the form of a second electric motor which is placed (FIG. 3, FIG. 6, FIG. 8) at the end of the fourth portion (14). The second electric motor can be a 24 Volt motor. The second drive (15) puts in rotation, if necessary with the interposition of a second reducer (16) a second articulated shaft (33, 34, 20) consisting of a third shaft (33) and a fourth shaft (34) which are connected to each other by means of a second joint (20), preferably in the form of a second universal joint. The second drive (15) puts in rotation the fourth shaft (34) which is placed below the fourth portion (14). The fourth shaft (34) develops in length according to a respective longitudinal direction (51) along the length of the fourth portion (14). The fourth shaft (34) is connected to the third shaft (33) by means of the second joint (20) which allows the fourth shaft (34) to transmit the rotational motion to the third shaft (33) and at the same time allows to transmit the rotational motion also in the conditions in which the fourth portion (14) is inclined with respect to the third portion (13). The third shaft (33) develops in length according to a respective longitudinal direction (51) along the length of the third portion (13). Advantageously the first articulated shaft (31, 32, 19) is independent with respect to the second articulated shaft (33, 34, 20), meaning that the first articulated shaft (31, 32, 19) and the second articulated shaft (33, 34, 20) are not connected to each other and can be controlled in a separate and independent way, thus obtaining a bed base (46) and a bed (1) which are more effective in their action of prevention or reduction of the effects of the long-term hospitalization of the user with reduced mobility. In fact, in this way it is possible to control separately the massaging action performed by means of the first articulated shaft (31, 32, 19) on the first portion (11) and on the second portion (12) and the massaging action performed by means of the second articulated shaft (31, 32, 19) on the third portion (13) and on the fourth portion (14). In other words, it is possible to control separately the massaging action performed in the zones of the user's pelvis, buttocks and back with reference to the first portion (11) and to the second portion (12) and the massaging action performed in the zones of the user's thighs and legs with reference to the third portion (13) and to the fourth portion (14).

This is advantageous also from the point of view of the reliability of the bed base (46) and of the bed (1) because the fact of having two distinct articulated shafts in the form of a first articulated shaft (31, 32, 19) which is dedicated to a first zone of the bed base (46) and a second articulated shaft (33, 34, 20) which is dedicated to a second zone of the bed base (46) prevents the use of a plurality of transmission joints placed one after the other to transmit motion to all the portions of the bed base, this solution being possibly subjected in time to the occurrence of mechanical blocks due to twists, wear, poor lubrication, dirt, with the consequent damage to other mechanical and electrical members of the bed base (46) or of the bed (1) as well.

With particular reference to the conversion of the rotational motion from the first shaft (31), second shaft (32), third shaft (33), fourth shaft (34) into a vertical reciprocating motion distributed along the lengthwise development of the bed base (46) or of the bed (1), this occurs by means of a series of cams (17). In fact, each of the shafts (31, 32, 33, 34) is provided with a series of cams (17) placed one after the other along the longitudinal direction (51) along which the respective shaft (31, 32, 33, 34) develops. The rotation of the respective shaft (31, 32, 33, 34) causes (FIG. 9, FIG. 10, FIG. 11, FIG. 12) the rotation of the cams (17). Each of the shafts (31, 32, 33, 34) is supported in several points by means of supports (18). The cams (17) are cams with an eccentric profile and are placed according to a configuration in which each cam (17) of the series of cams of each shaft (31, 32, 33, 34) is rotated with respect to the previous or following cam (17) by an angle of rotation between 50 and 70 degrees, preferably approximately 60 degrees. In practice the coupling means or cams (17) are placed along the first articulated shaft (31, 32, 19) and second articulated shaft (33, 34, 20) according to such an arrangement as to move vertically by deflection the slats (6) according to a sinusoidal conformation. By the described configuration a sinusoidal wave is created, which has an alternate decompression effect on all the surfaces of the body. As previously described, the drives (8, 15) of the massaging means can also comprise respective reducers (9, 16). In this configuration the drive (8, 15), for example in the form of a 24 Volt motor, activates the respective reducer (9, 16) which transmits to the cams a rotation of one turn every 90 degrees of rotation of the motor, moving the slats (6) downwards and upwards and thus creating a sinusoidal wave which has a height between 2 and 5 cm, preferably 3 cm, so as to cause the detachment and relieve pressure on the user's body parts.

The cams (17) or coupling means (17) for coupling with the slats (6) are configured and structured according to an arrangement along the respective shafts (31, 32, 33, 34) such that groups of at least two, preferably three consecutive coupling means or cams (17) are reciprocally synchronized (FIG. 3, FIG. 4, FIG. 5, FIG. 6) in the vertical movement of deflection of the slats (6), that is to say, in the movement of lifting and lowering of the slats (6). In practice a first group of at least two coupling means or cams (17), preferably three consecutive coupling means or cams (17) along the longitudinal development direction (51) is configured to flex the corresponding slats (6) along a first longitudinal extension (7') while a second group of at least two coupling means or cams (17), preferably three consecutive coupling means or cams (17) along the longitudinal development direction (51) is configured to flex the corresponding slats (6) along a second longitudinal extension (7"). Preferably the first group of cams and the second group of cams are adjacent groups of cams. The first longitudinal extension (7') and the second longitudinal extension (7") are between 10 and 20 cm, the preferred value being 15 cm.

The movement of the slats thus generates a slow variation of the support points of the user's body. This movement has a double action because it decreases the pressure on the zones at risk of occurrence of bedsores and it improves blood circulation, which is useful both in reparative processes and in prevention, without causing a rise in the body temperature which would be harmful for any bedsores which may be present.

As previously explained, the bed base (46) and, therefore, the bed (1) are provided (FIG. 1) with control means (4) for controlling the driving means (8, 15) and the massaging means (6, 7, 17, 31, 32, 33, 34, 8, 15). The control means (4) can be made in the form of a remote control provided with a wire, which connects it to the driving means (8, 15) and to the massaging means (6, 7, 17, 31, 32, 33, 34, 8, 15) or to a control unit of the latter. As an alternative one can also resort to wireless control means (4) which communicate according to a wireless communication mode with the control unit or with a respective pair of control units of which a first control unit which checks the driving means (8, 15) and a second control unit which checks the massaging means (6, 7, 17, 31, 32, 33, 34, 8, 15). In an embodiment it can be provided that one single control unit is integrated directly in the control means (4), also providing buttons for selecting different operating modes of the massaging means, such as a series of massaging programs each of which can for example relate to:

- massaging function performed exclusively on the first portion (11) and on the second portion (12) by activating the first drive (8), if necessary also providing different programs for operating the first drive (8) at different speeds;
- massaging function performed exclusively on the third portion (13) and on the fourth portion (14) by activating the second drive (15), if necessary also providing different programs for operating the second drive (15) at different speeds;
- massaging function performed alternatively on the first portion (11) or on the second portion (12) and subsequently on the third portion (13) and on the fourth portion (14);
- massaging function performed on the first portion (11) and on the second portion (12) at a first massaging speed with the simultaneous massaging function performed on the third portion (13) and on the fourth portion (14) at a second massaging speed different from the first speed;
- massaging function performed on the first portion (11), second portion (12), third portion (13) and fourth portion (14) all operating at the same speed.

Furthermore, one can also provide timings of the massaging programs, such as

- a first timing in which first the drives (8, 15) are activated according to one of the previously described functions for a first time, for example between 5 and 20 minutes, such as a first time of 15 minutes, and in which afterwards the drives (8, 15) are switched off for a second time, for example between 30 minutes and 90 minutes, such as 60 minutes, this timing being then repeated in a continuous cycle;
- a second timing in which first the drives (8, 15) are activated according to one of the previously described functions for a first time, for example between 5 and 20 minutes, such as a first time of 15 minutes, and in which afterwards the drives (8, 15) are switched off for a second time, for example between 90 minutes and 150 minutes, such as 120 minutes, this timing being then repeated in a continuous cycle;
- a third timing in which first the drives (8, 15) are activated according to one of the previously described functions for a first continuous period, for example equal to a number of hours greater than 2, such as a number of hours between 3 and 15, such 12 hours, this timing being interrupted at the end of the defined first continuous period;
- a fourth timing in which first the drives (8, 15) are activated according to one of the previously described functions for a second continuous period, for example equal to a number of hours greater than 15, such as a number of hours between 16 and 30, such as 24 hours, this timing being interrupted at the end of the defined second continuous period.

The massaging action occurs by means of the previously described cams (17) which act on the slats (6) which are slats made of a flexible plastic material which move downwards and upwards under the action of the cams (17) thus creating the previously described longitudinal sinusoidal wave. Therefore, one obtains an effective detachment of the support surface of the user, creating an alternate decompression on all the surfaces of the body.

For example (FIG. 9, FIG. 10, FIG. 11) each cam (17) can act on a central zone (29) of the slat (6), the term central referring to the transversal development of the slat (6), the transversal development of the slat being essentially orthogonal with respect to the previously defined longitudinal direction (51) along which the shafts (30, 31, 32, 33, 34) develop. The cam (17) acts below an integral plate (45), fixed or anchored to the slat (6), by means of which the cam (17) exerts its pushing action on the central zone (29) of the slat (6).

The slat (6) is provided, in the central zone (29) with respect to its transversal extension, with a body (38) having a greater thickness with respect to two side wings which extend from the central body (38) in reciprocally opposite directions to form the overall transversal development of the slat (6). Each wing is further provided with a strengthening zone (37) which is obtained by means of an increase in the thickness of the side wing, said increase in the thickness being obtained by means of a bulge which develops on the lower side of the slat (6) in such a way that the slat (6) has a flat surface on the upper part, that is to say, on the side facing the mattress or facing upwards when said bed base (46) is in a condition of use. The slats (6) are provided with at least one first end (36), which is free to move longitudinally within a first seat (39) of a first guiding element (10) when the slats (6) are moved vertically by deflection by means of the rotary shaft (30, 31, 32, 33, 34). In practice a first end (36) of the slat (6) is shaped and structured to couple in a movable way with the first seat (39) of the first guiding element (10), said coupling resulting in a fixing of the slat to the guiding element (10) according to a configuration in which the first end (36) of the slat (6) is free to slide inside the first seat (39) of the guiding element (10). By means of this configuration the first end (36) of the slat (6), being free to slide, does not constitute an obstacle to the vertical deformation of the slat (6) to obtain the described massaging effect without creating frictions, resistance to deformation or excessive stresses which may lead to a premature breaking of the slat (6), besides improving the overall properties of the massaging system as well.

The slats (6) are provided with a second end (35) which is fixed to a second guiding element (10) according to an arrangement which does not allow the second end (35) to slide with respect to said second guiding element (10) which is placed on the opposite side of the slat (6) with respect to the first end (36). In practice the second end (35) of the slat (6) is shaped and structured to couple in a fixed way with the first seat (39) of the second guiding element (10), said coupling resulting in a solid fixing of the slat to the guiding element (10).

The guiding element (10) is a section. The assembly of guiding elements which are reciprocally opposite elements with respect to the longitudinal direction (51) forms a respective frame (41, 42, 43, 44) for each of the portions (11, 12, 13, 14), on said frame (41, 42, 43, 44) a number of slats (6) being applied, which are placed one after the other along the longitudinal direction (51).

Figure 13:
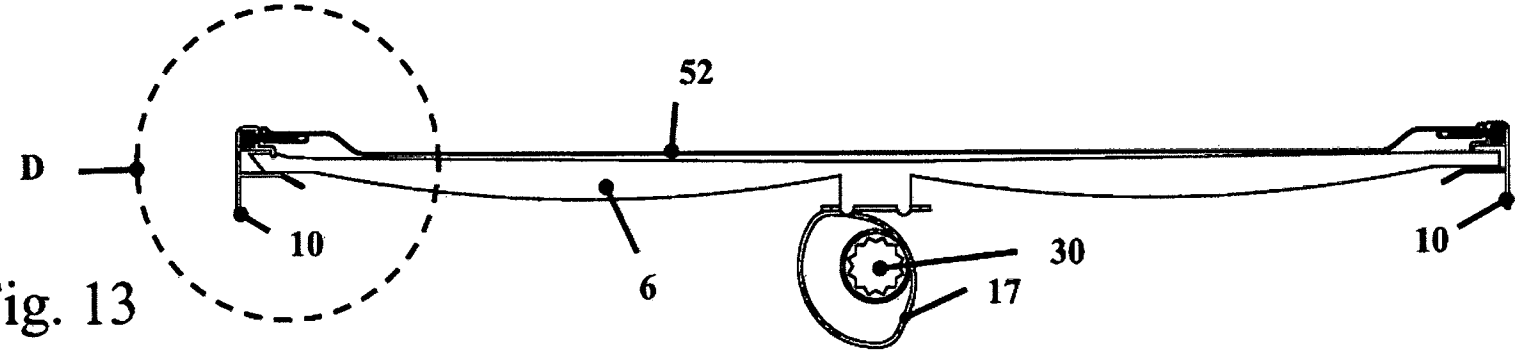
FIG. 13 shows the application of a protection oilcloth or impermeable cloth.
Figure 14:
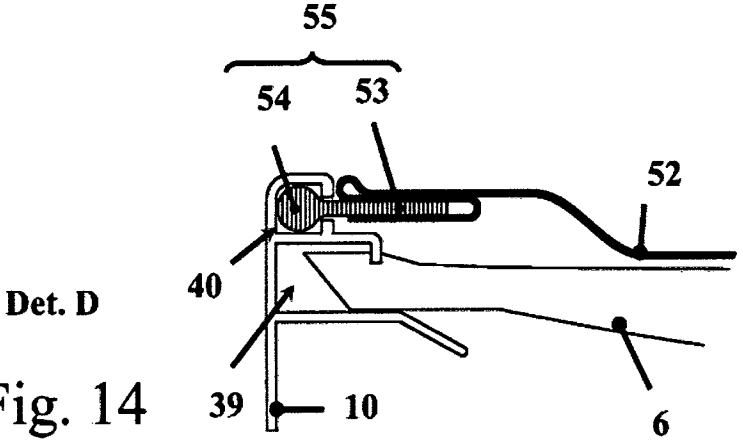
FIG. 14 is an enlargement of the detail indicated with "D" in FIG. 13.

The guiding element (10) can also comprise (FIG. 13, FIG. 14) a further second seat (40) which is intended for the application of an oilcloth or impermeable cloth (52) which covers all the mechanical parts from any possible liquids that may leak on them. The second seat (40) is essentially "C" shaped and is placed above the first seat (39), the term above referring to the direction of the force of gravity when the bed base (46) is in a condition of use. The reciprocally opposite guiding elements which form the frame (41, 42, 43, 44) are oriented with respect to each other according to an arrangement in which the respective second seat (40) of the first guiding element (10) is oriented with the opening of the "C" shape towards the opening of the "C" shape of the second seat (40) of the second guiding element (10) obtaining a configuration in which the "C" shapes are facing each other with their respective openings. In this way the second seats (40) facing each other constitute the insertion seats for the impermeable cloth (52).

Preferably the cloth (52) comprises in correspondence of both its transversal ends one or more fixing elements (55), that is to say, a first fixing element (55) on a first transversal end of the cloth (52) and a second fixing element (55) on a second transversal end of the cloth (52). For example the fixing elements (55) can be made in the form of fixing elements provided with a first zone (54) having a greater section than the section of a second zone (53). The first fixing element (55) is inserted by means of the first zone (54) into the second seat (40) of the first guiding element (10) on a first side of the bed base (46) and the second fixing element (55) is inserted by means of the first zone (54) into the second seat (40) of the second guiding element (10) on a second side of the bed base (46), opposite to the first side. The fixing elements can be continuous elements which develop along the entire length of the cloth (52) or they can be several fixing elements placed along the length of the cloth (52). In that case, as regards the first fixing elements (55), which are on a first transversal end of the cloth (52), they are inserted by means of the first zone (54) into the second seat (40) of the first guiding element (10) on a first side of the bed. Similarly, as regards the second fixing elements (55) which are on a second transversal end of the cloth (52), they are inserted by means of the first zone (54) into the second seat (40) of the second guiding element (10) on a second side of the bed, opposite to the first side of the bed. In this way the cloth (52) is transversely blocked by means of the second seats (40) and covers and protects the bed base or the lower portion of the bed where there are all the previously described mechanisms, the term lower referring to the direction of the force of gravity when said bed base (46) is in a condition of use. It will be evident that other forms of fixing of the cloth (52) can be used as well. Advantageously the second zone (53) of the fixing element (55) has an essentially flat shape and the cloth is turned up on said second essentially flat zone (53) in such a way as to wrap said second zone (53) and cover it on both sides and in such a way as to enclose said second zone (53) by means of the cloth (52) which is subsequently fixed by means of a seam. In this way one obtains a solid and reliable fixing of the cloth (52) to the fixing elements (55).

The bed base (46) and the bed (1) can be configured both for use in a hospital and for use in a private or home environment. One can also provide the bed base (46) without the structure (2) for its application on an existing bed as well as it can be provided that the bed base (46) is provided along with the structure (2) but without the feet (5) in such a way as to be able to be placed on an existing support, such as a traditional bed. Finally, the bed base (46) can be provided along with the structure (2) and it can be equipped with the feet (5) of support on the ground, in this case constituting the bed (1) according to the invention.

In general the present invention relates (FIG. 3, FIG. 7, FIG. 8, FIG. 12) to a bed base (46) for fixing to a bed (1) and also relates (FIG. 1, FIG. 2) to a bed (1) comprising said bed base (46). The bed base (46) is provided with massaging means (6, 7, 17, 31, 32, 33, 34, 8, 15) comprising slats (6) which are placed one after the other and which define a support plane for a mattress (3). Each of the slats (6) is placed essentially transversely with respect to a longitudinal direction (51) of the support plane for the mattress (3). The bed base (46) is subdivided into several contiguous portions (11, 12, 13, 14), which are placed one after the other along the longitudinal direction (51), said portions (11, 12, 13, 14) being hinged to each other by means of respective hinges (21, 22, 23, 24) according to such a structure that at least some of said portions (11, 12, 13,14) are movable and positionable according to at least two configurations, a first configuration of which is a configuration in which the portions (11, 12, 13,14) are aligned with respect to each other forming the support plane for the mattress (3), and a second configuration of which is a configuration in which one or more of the portions (11, 12, 13,14) is inclined with respect to the adjacent portion. The slats (6) are movable vertically by deflection by means of at least one rotary shaft (30, 31, 32, 33, 34) provided with coupling means (17) for coupling with the slats (6). The massaging means (6, 7, 17, 31, 32, 33, 34, 8, 15) comprise:

- a first drive (8) which puts in rotation a first articulated shaft (31, 32, 19); and
- a second drive (15) which puts in rotation a second articulated shaft (33, 34, 20).

The first articulated shaft (31, 32, 19) and the second articulated shaft (33, 34, 20) are mechanically unconnected and independent with respect to each other, the first articulated shaft (31, 32, 19) moving a first series of slats (6) which are located on a first group of portions (11, 12) which is a distinct and independent group with respect to a second group of portions (13, 14) comprising a second series of slats (6) moved by means of the second articulated shaft (33, 34, 20).

The portions (11, 12, 13, 14) are preferably four portions consisting of a first portion (11), a second portion (12), a third portion (13), a fourth portion (14). The first portion (11) is a fixed portion with respect to which the second portion (12) and the third portion (13) are movable, the first portion (11) constituting the coupling interface for fixing the bed base (46) to the bed (1). The first articulated shaft (31, 32, 19) moves the first series of slats (6) which are located on the first group of portions (11, 12) which consists of the first portion (11) and of the second portion (12). The second articulated shaft (33, 34, 20) moves the second series of slats (6) which are located on the second group of portions (13, 14) which consists of the third portion (13) and of the fourth portion (14), which is movable with respect to the third portion (13) to which it is fixed by means of a respective hinge (21, 22, 23, 24).

The first articulated shaft (31, 32, 19) consists (FIG. 3, FIG. 4, FIG. 12) of a first shaft (31) and of a second shaft (32), which are connected to each other by means of a first joint (19) preferably in the form of a first universal joint. The second articulated shaft (33, 34, 20) consists (FIG. 4, FIG. 5, FIG. 6, FIG. 8) of a third shaft (33) and a fourth shaft (34) which are connected to each other by means of a second joint (20) preferably in the form of a second universal joint. The first shaft (31) is located below the first portion (11), the second shaft (32) is located below the second portion (12), the third shaft (33) is located below the third portion (13), the fourth shaft (34) is located below the fourth portion (14).

The coupling means (17) for coupling with the slats (6) are (FIG. 9, FIG. 10, FIG. 11, FIG. 12) cams (17) provided with an eccentric zone (56) and with an essentially non-eccentric zone (57) with respect to a rotational fulcrum of the cam (17), the eccentric zone (56) and the essentially non-eccentric zone (57) being located on opposite sides with respect to the centre of the rotary shaft (30, 31, 32, 33, 34).

The cams (17) are put in rotation by means of the rotary shaft (30, 31, 32, 33, 34), each of the cams (17) being hooked to a corresponding slat (6) by means of a coupling interface (45), preferably in the form of a plate. The coupling interface (45) and the cam (17) are configured and structured in such a way as to:

exert a pushing action with the consequent lifting of at least one part of the slat (6) above with respect to the support plane of the mattress when the eccentric zone (56) is facing the slat (6) during the rotation of the cam (17) controlled by means of the rotary shaft (30, 31, 32, 33, 34);

exert a traction action with the consequent lowering of at least one part of the slat (6) below with respect to the support plane of the mattress when the non-eccentric zone (57) is facing the slat (6) during the rotation of the cam (17) controlled by means of the rotary shaft (30, 31, 32, 33, 34).

The coupling interface (45) and the cam (17) are hooked to each other.

The present invention also relates to a bed (1) of the type comprising a bed base (46) provided with massaging means (6, 7, 17, 31, 32, 33, 34, 8, 15) including slats (6) which are placed one after the other and which define a support plane for a mattress, wherein the bed is provided with a bed base (46) made as previously described.

The description of the present invention has been made with reference to the enclosed figures in a preferred embodiment, but it is evident that many possible changes, modifications and variations will be immediately clear to those skilled in the art in the light of the previous description. Thus, it must be underlined that the invention is not limited to the previous description, but it includes all the changes, modifications and variations in accordance with the appended claims.

NOMENCLATURE USED

With reference to the identification numbers in the enclosed figures, the following nomenclature has been used:

1. Bed
2. Structure
3. Mattress
4. Control means
5. Foot
6. Slat
7'. First extension
7". Second extension
8. First motor or first drive
9. First reducer
10. Guiding element
11. First portion
12. Second portion
13. Third portion
14. Fourth portion
15. Second motor or second drive
16. Second reducer
17. Cam
18. Support
19. First joint
20. Second joint
21. First hinge
22. Second hinge
23. Third hinge
24. Second anchoring element
25. Second actuator
26. First anchoring element
27. First actuator
28. Rod
29. Central zone
30. Shaft
31. First shaft
32. Second shaft
33. Third shaft
34. Fourth shaft
35. Second end
36. First end
37. Strengthening zone
38. Body
39. First seat
40. Second seat
41. First frame
42. Second frame
43. Third frame
44. Fourth frame
45. Plate
46. Bed base
47. First side
48. Second side
49. Fourth hinge
50. Fifth hinge
51. Longitudinal direction
52. Cloth
53. Second zone
54. First zone
55. Fixing element
56. Eccentric zone
57. Non-eccentric zone
x. First angle
y. Second angle

The invention claimed is:

1. A bed base for fixing to a bed, the bed base comprising:

a plurality of slats positioned one after another so as to define a support plane for a mattress, each of said plurality of slats being placed transversely with respect to a longitudinal direction of the support plane;

a plurality of contiguous portions placed one after another along the longitudinal direction, said plurality of contiguous portions being hinged to each other by respective hinges, at least some of said plurality of contiguous portions being movable and positionable in at least two configurations, one of the at least two configurations having said plurality of contiguous portions being aligned with respect to each other so as to as form the support plane, another of the at least two configurations having at least one of said plurality of contiguous portions inclined with respect to an adjacent portion of said plurality of contiguous portions;

at least one rotary shaft coupled with said plurality of slats so as to move said plurality of slats vertically by deflection;

a first drive having a first articulated shaft; and a second drive having a second articulated shaft, wherein said first articulated shaft and said second articulated shaft are mechanically unconnected and independent of each other, the first articulated shaft being connected to a first series of slats of said plurality of slats so as to move the first series of slats, the first series of slats being placed at a first group of said plurality of contiguous portions, the second articulated shaft being connected to a second series of slats of said plurality of slates so as to move the second series of slats, the second series of slats being placed at a second group of said plurality of contiguous portions, wherein said plurality of contiguous portions comprise a first portion and a second portion and a third portion and a fourth portion, the first portion being fixed with respect to the second portion and the third portion, the second portion and the third portion being movable, the first group of the plurality of contiguous portions being the first portion and the second portion, the second group of the plurality of contiguous portions being the third portion and the fourth portion, wherein the first articulated shaft has a first shaft and a second shaft that are connected to each other by a first joint, the second articulated shaft having a third shaft and a fourth shaft connected to each other by a second joint, the first shaft positioned below the first portion, the second shaft positioned below the second portion, the third shaft positioned below the third portion, the fourth shaft positioned below the fourth portion.

2. The bed base of claim 1, further comprising:

a plurality of cams having an eccentric zone and a non-eccentric zone with respect to a rotational fulcrum of the respective cam, the eccentric zone and the non-eccentric zone being on opposite sides with respect to a center of the rotary shaft, the rotary shaft driving the cam in rotation, each of said plurality of cams being hooked to a corresponding slat of said plurality of slats by a coupling interface, the coupling interface adapted to exert a pushing action so as to lift at least one part of the slat above the support plane when the eccentric zone is facing the slat during the rotation of the cam, the coupling interface adapted to exert a traction force so as to lower at least one part of the slat below the support plane when the non-eccentric zone faces the slat during the rotation of the cam.

3. The bed base of claim 2, wherein the coupling interface and the cam are hooked to each other.

4. The bed base of claim 1, wherein said plurality of slats have at least one first end that is freely movable longitudinally within a first seat of a first guiding element when said plurality of slats are moved vertically by deflection by said rotary shaft.

5. The bed base of claim 4, wherein said plurality of slats have a second end that is fixed to a second guiding element, the second end being prevented from sliding with respect to the second guiding element.

6. The bed base of claim 5, wherein said each of the first and second guiding elements is a section, the first and second guiding elements being reciprocally opposite with respect to the longitudinal direction so as to form a respective frame for each of said plurality of contiguous portions.

7. The bed base of claim 6, wherein said wherein each of the first and second guiding elements has a second seat having a generally C-shape, the C-shape having an opening above a first seat, the first and second guiding elements being arranged in which the second seat of the first guiding element is oriented with the opening of the C-shape of the second seat of the second guiding element, the second seats facing each other so as to define and insertion seat for an impermeable cloth.

8. The bed base of claim 7, the impermeable cloth having a first fixing element on a first transversal end thereof and a second fixing element on a second transversal end thereof, the first fixing element and the second fixing element each having a first zone and a second zone, the first zone having larger section than a section of the second zone, the first fixing element being inserted by the first zone into the second seat of the first guiding element, the second fixing element being inserted by the first zone into the second seat of the second guiding element, the impermeable cloth being transversely blocked by the second seats.

9. The bed base of claim 1, each of said plurality of slats being formed of a flexible plastic material.

10. The bed base of claim 1, each of said plurality of slats has a central body in a central zone thereof, the central body having a pair of side wings extending from the central body in reciprocally opposite directions, the central body having a thickness that is greater than a thickness of the pair of side wings, each of the pair of side wings having a strengthening zone of increased thickness, the increased thickness being a bulge formed on a lower part of the slat, the slat having a flat surface at an upper portion thereof.

11. The bed base of claim 2, wherein the coupling interfaces are reciprocally synchronized with respect to the vertical movement of deflection of said plurality of slats, the coupling interfaces being adapted to flex the corresponding slats along a first longitudinal extension.

12. The bed base of claim 11, wherein the first longitudinal extension has a length of between 10 and 20 centimeters.

13. The bed base of claim 12, wherein a group of coupling interfaces is adapted to flex the corresponding slats along a second longitudinal extension.

14. The bed base of claim 13, wherein the second longitudinal extension has a length of between 10 and 20 centimeters.

15. The bed base of claim 13, wherein the coupling interfaces have reciprocally adjacent groups along the longitudinal direction.

16. The bed base of claim 1, wherein the first drive and the second drive are 24 volt motors.

17. The bed base of claim 2, wherein the coupling interface is configured to move the respective slats of said plurality of slats vertically by deflection for the distance of between 2 and 5 centimeters.

18. The bed base of claim 2, wherein said coupling interfaces are placed on the first articulated shaft and the second articulated shaft so as to move the slats vertically by deflection in a sinusoidal pattern.

19. A bed comprising a bed base according to claim 1.

* * * * *